US006726303B2

(12) United States Patent
Otsuki

(10) Patent No.: US 6,726,303 B2
(45) **Date of Patent: *Apr. 27, 2004**

(54) CORRECTION OF POSITIONAL MISALIGNMENT IN BIDIRECTIONAL PRINTING BY TAKING INTO ACCOUNT INCLINATION OF NOZZLE ARRAY

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/306,223

(22) Filed: Nov. 29, 2002

(65) Prior Publication Data

US 2003/0085937 A1 May 8, 2003

Related U.S. Application Data

(63) Continuation of application No. 09/786,335, filed as application No. PCT/JP00/04501 on Jul. 6, 2000.

(30) Foreign Application Priority Data

Jul. 8, 1999 (JP) ..... 11-193903

(51) Int. Cl.[7] ..... B41J 29/393
(52) U.S. Cl. ..... 347/19
(58) Field of Search ..... 347/12, 14, 19, 347/37, 39, 40, 43; 400/74

(56) References Cited

U.S. PATENT DOCUMENTS 5,455,610 A * 10/1995 Harrington ..... 347/43
6,082,911 A * 7/2000 Murakami ..... 400/74
6,084,606 A * 7/2000 Moriyama ..... 347/19
6,315,382 B1 * 11/2001 Gudaitus et al. ..... 347/19
6,334,720 B1 * 1/2002 Kato et al. ..... 400/74
6,364,447 B1 * 4/2002 Boleda et al. ..... 347/19
6,367,903 B1 * 4/2002 Gast et al. ..... 347/9
6,554,387 B1 * 4/2003 Otsuki ..... 347/19

FOREIGN PATENT DOCUMENTS

| | | |
|---|---|---|
| JP | 5-69625 | 3/1993 |
| JP | 7-25101 | 1/1995 |
| JP | 2000-062156 | 2/2000 |
| JP | 2000-127370 | 5/2000 |
| JP | 2000-141624 | 5/2000 |

* cited by examiner

*Primary Examiner*—Stephen D. Meier
*Assistant Examiner*—Blaise Mouttet
(74) *Attorney, Agent, or Firm*—Oblon, Spivak, McClelland, Maier & Neustadt, P.C.

(57) ABSTRACT

A correction value, which is used to correct misalignment of recording positions in a main scanning direction, is determined using a representative nozzle sub-array as a reference. The representative nozzle sub-array is within a predetermined range around the center of a nozzle array provided on a print head. The correction value is set, based on a positional misalignment test pattern printed with the representative nozzle sub-array. The misalignment of recording positions in the main scanning direction in the course of bidirectional printing is corrected with the correction value.

13 Claims, 11 Drawing Sheets

CORRECTION OF POSITIONAL MISALIGNMENT IN BIDIRECTIONAL PRINTING BY TAKING INTO ACCOUNT INCLINATION OF NOZZLE ARRAY

This application is a Continuation of application Ser. No. 09/786,335 Filed on Mar. 8, 2001, which was filed as PCT/JP00/04501 on Jul. 6, 2000.

TECHNICAL FIELD

The present invention relates to a technique that carries out bidirectional, reciprocating main scan to print an image on a printing medium. More specifically the present invention pertains to a technique that adjusts misalignment of dot recording positions in a main scanning direction between a forward pass and a backward pass of the main scan.

BACKGROUND ART

Recently color printers having a print head that ejects a plurality of different color inks have been widely used as an output device of computers. Some of such color printers have the function of "bidirectional printing" for the enhancing printing speed.

In bidirectional printing, misalignment of recording positions in a main scanning direction on a forward pass and a backward pass of main scan often arises due to a backlash of a driving mechanism in the main scanning direction or a warp of a platen that supports a printing medium. One of the techniques proposed to relieve such positional misalignment is disclosed in JPA 5-69625 filed by the applicant of the present invention. This prior art technique registers in advance a potential amount of positional misalignment (deviation in printing) in the main scanning direction and corrects the dot recording positions on the forward pass and on the backward pass, based on the registered amount of positional misalignment.

The print head of the printer generally has a nozzle array that includes a large number of nozzles arranged in a sub-scanning direction. When the print head is driven in the main scanning direction, mechanical vibrations may occur on the print head to slightly shift the orientation of the nozzle array from the sub-scanning direction. Furthermore, the nozzle array may be slightly inclined to different orientations on the forward pass and on the backward pass, for example, due to the backlash of the driving mechanism in the main scanning direction. In such cases, it is difficult to accurately determine the amount of potential positional misalignment, since the nozzle array does not move back and forth keeping the specified posture perpendicular to the main scanning direction as a whole.

The object of the present invention is to solve the problem of the prior art technique discussed above and accordingly to provide a technique that relieves positional misalignment in the main scanning direction on a forward pass and a backward pass of main scan with regard to a nozzle array in a printing apparatus of bidirectional printing.

DISCLOSURE OF THE INVENTION

In order to attain at least part of the above and the other related objects, the present invention is directed to a printing apparatus that comprises a print head having a nozzle array, which is arranged in a sub-scanning direction and ejects ink droplets to record dots on a printing medium, and carries out bidirectional, reciprocating main scan to complete printing on the printing medium. With this printing apparatus, a positional misalignment test pattern is printed on the printing medium with a representative nozzle sub-array, which is part of the nozzle array and is within a predetermined range around a center of the nozzle array. Then a correction value is determined according to correction information that represents a favorable correction state selected based on the positional misalignment test pattern, where the correction value is used to correct the misalignment of recording positions in the main scanning direction on the forward pass and the backward pass of the main scan. The misalignment of recording positions in the main scanning direction is actually corrected with the correction value thus determined in the course of bidirectional printing. Here "the representative nozzle sub-array that is within a predetermined range around a center of the nozzle array" represents a group of plural nozzles that includes a specific nozzle closest to the center position along the length of the nozzle array and does not include end nozzles on either end of the nozzle array.

In the case where the angle of the nozzle array in the main scanning direction on the forward pass is slightly different from that on the backward pass, a correction value determined using a nozzle on one end of the nozzle array would cause a significant misalignment of recording positions of ink droplets with regard to the nozzles on the other end of the nozzle array. The arrangement of the present invention determines the correction value on the basis of the nozzles in the neighborhood of the center of the nozzle array. Accordingly, it reduces the total misalignment of dot recording positions, due to the variation in the angle of the nozzle array. The technique of the invention determines the correction value according to the correction information which represents the favorable correction state selected based on the positional misalignment test pattern printed with the representative nozzle sub-array. The correction value is determined not on the basis of deductive inference but on the basis of the positional misalignment test pattern actually printed on a printing medium. The correction value can thus be determined adequately to relieve the actual printing misalignment.

The nozzle array preferably comprises: a color nozzle array including a plurality of color nozzles to eject color ink that are arranged in a predetermined sequence in the sub-scanning direction; and a black nozzle array including a plurality of black nozzles to eject black ink that are arranged in a predetermined sequence in the sub-scanning direction. In this application, a memory included in the printing apparatus stores a first correction value and a second correction value therein. The first correction value is set for correcting the positional misalignment of recording positions in the main scanning direction on the forward pass and the backward pass of the main scan with regard to a representative color nozzle sub-array, which is part of the color nozzle array and is within a predetermined range around a center of the color nozzle array. The second correction value is set for correcting the positional misalignment of recording positions in the main scanning direction on the forward pass and the backward pass of the main scan with regard to a representative black nozzle sub-array, which is part of the black nozzle array and is within a predetermined range around a center of the black nozzle array. Here the color nozzle array and the black nozzle array may have any positional relationship.

This arrangement corrects the misalignment of recording positions in the course of bidirectional printing with the first correction value, which reflects the characteristics of the color nozzle array, and with the second correction value, which reflects the characteristics of the black nozzle array.

Namely the arrangement of using both the first correction value and the second correction value can reflect the characteristics of the color nozzle array and the black nozzle array on the correction of the misalignment of recording positions in the course of bidirectional printing.

The positional misalignment correction unit may correct the misalignment of recording positions in the main scanning direction in the course of bidirectional printing with regard to the nozzle array with a mean value of the first correction value and the second correction value. This arrangement readily corrects the misalignment of recording positions in the course of bidirectional printing by taking into account both the color nozzle array and the black nozzle array.

It is preferable that the positional misalignment correction unit corrects the misalignment of recording positions with the first correction value in a print mode that the nozzles of the color nozzle array are used. In the case of color printing, this arrangement carries out the correction with the first correction value that reflects the characteristics of the color nozzle array. This accordingly ensures the correction of recording positions suitable for color printing.

It is also preferable that the positional misalignment correction unit corrects the misalignment of recording positions with the second correction value in a print mode that the nozzles of the color nozzle array are not used. In the case of monochromatic printing, this arrangement carries out the correction with the second correction value that reflects the characteristics of the black nozzle array. This accordingly ensures the correction of recording positions suitable for monochromatic printing.

The positional misalignment correction unit may correct the misalignment of recording positions with the first correction value with regard to the color nozzle array, and corrects the misalignment of recording positions with the second correction value with regard to the black nozzle array. This arrangement ensures the optimum corrections for both the color nozzle array and the black nozzle array in the process of one printing operation.

It is preferable that the color nozzle array includes yellow nozzles for ejecting yellow ink, cyan nozzles for ejecting cyan ink, and magenta nozzles for ejecting magenta ink, and that the representative color nozzle sub-array consists of either of cyan nozzles and magenta nozzles.

In the arrangement of determining the correction value on the basis of the representative nozzle sub-array that is within the predetermined range in the neighborhood of the center of the nozzle array, the nozzles in the neighborhood of both the ends of the nozzle array have a greater degree of misalignment of dot recording positions in the main scanning direction than the nozzles in the neighborhood of the center of the nozzle array. Among yellow, cyan, and magenta, the misalignment of recording positions in yellow is least conspicuous. The misalignment of recording positions in magenta and cyan is more conspicuous than that in yellow. In this preferable structure, the cyan nozzles or the magenta nozzles are arranged in the neighborhood of the center of the nozzle array and the correction value is determined with either the cyan nozzles or the magenta nozzles as the representative color nozzle sub-array. This arrangement makes the total misalignment of recording positions of dots sufficiently inconspicuous.

The present invention is realized by a diversity of applications as given below:

(1) Bidirectional printing apparatus;

(2) Method of bidirectional printing;

(3) Method of correcting misalignment of recording positions in the course of bidirectional printing;

(4) Computer programs to attain any of the above apparatus and methods;

(5) Recording media in which computer programs to attain any of the above apparatus and methods is recorded; and (6) Data signals that include computer programs to attain any of the above apparatus and methods and are embodied in carrier waves.

BEST MODES OF CARRYING OUT THE INVENTION

A. Structure of Apparatus

Figure 1:
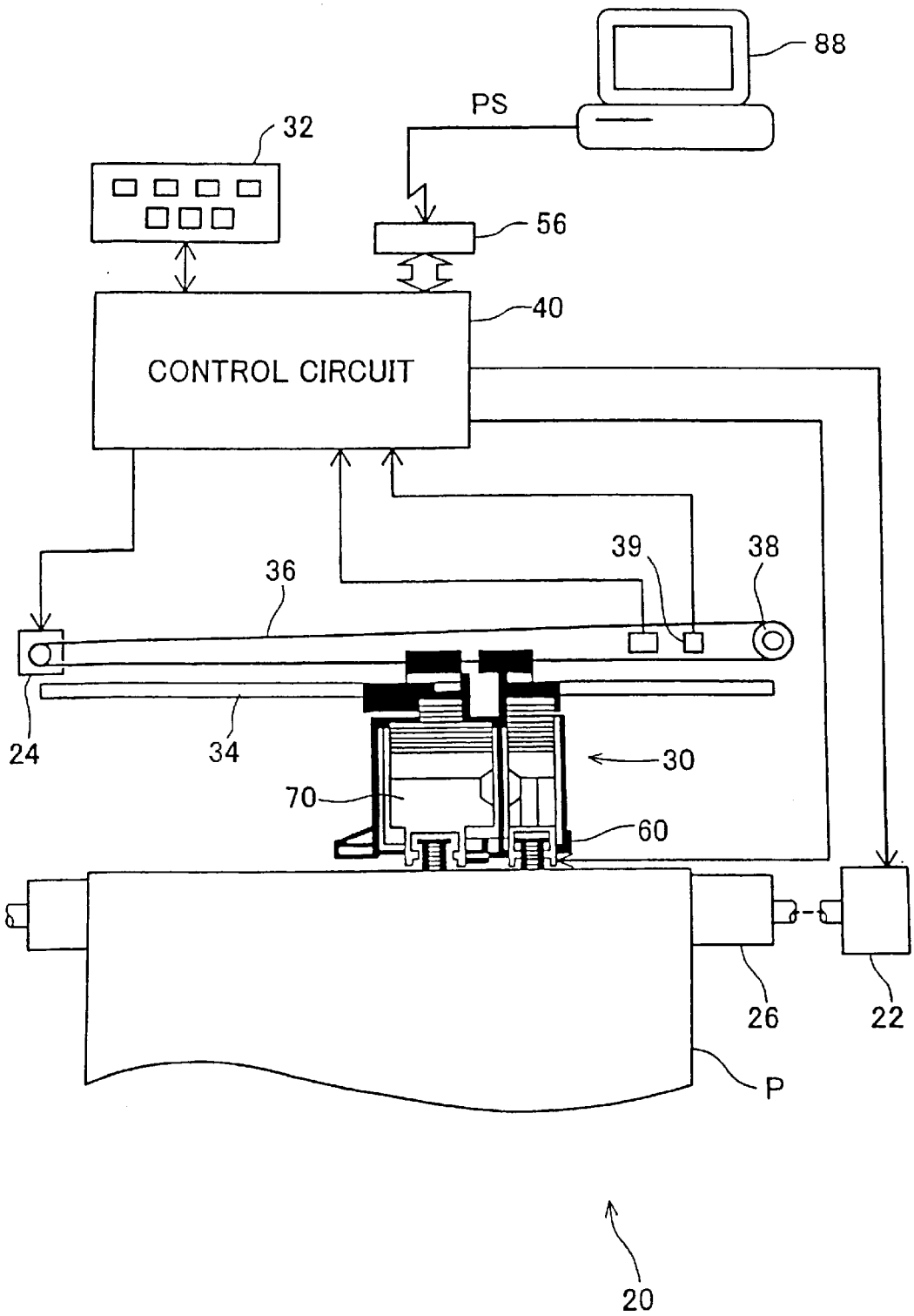
FIG. 1 schematically illustrates the structure of a printing system including an ink jet printer 20 in a first embodiment.

Some modes of carrying out the present invention are described below as preferred embodiments. FIG. 1 schematically illustrates the structure of a printing system including an ink jet printer 20 in a first embodiment of the present invention. The printer 20 includes a sub-scan mechanism that drives a sheet feed motor 22 to feed a sheet of printing paper P in a sub-scanning direction, a main scan mechanism that drives a carriage motor 24 to move a carriage 30 back and forth along an axis of a platen 26 (in a main scanning direction), a head driving mechanism that drives a print head unit 60 (also referred to as "print head assembly") mounted on the carriage 30 to control ejection of ink and creation of dots, and a control circuit 40 that controls transmission of signals to and from the sheet feed motor 22, the carriage motor 24, the print head unit 60, and a control panel 32. The control circuit 40 is connected to a computer 88 via a connector 56.

The sub-scan mechanism for feeding the printing paper P has a gear train (not shown) that transmits the rotations of the sheet feed motor 22 to the platen 26 and a sheet feed roller (not shown). The main scan mechanism for reciprocating the carriage 30 includes a sliding shaft 34 that is arranged in parallel with the axis of the platen 26 to support the carriage 30 in a slidable manner, a pulley 38 that is combined with the carriage motor 24 to support an endless drive belt 36 spanned therebetween, and a position sensor 39 that detects the starting position of the carriage 30. Another arrangement may alternatively be applied for the main scan and the sub-scan. The printer carries out the bidirectional, reciprocating main scan to change the relative position of the print head to the printing medium while ejecting ink from the nozzles and also performs the sub-scan between adjoining passes of the main scan to change the relative position of the print head to the printing medium in a direction different from the direction of the main scan, thereby effecting print on the printing medium.

Figure 2:
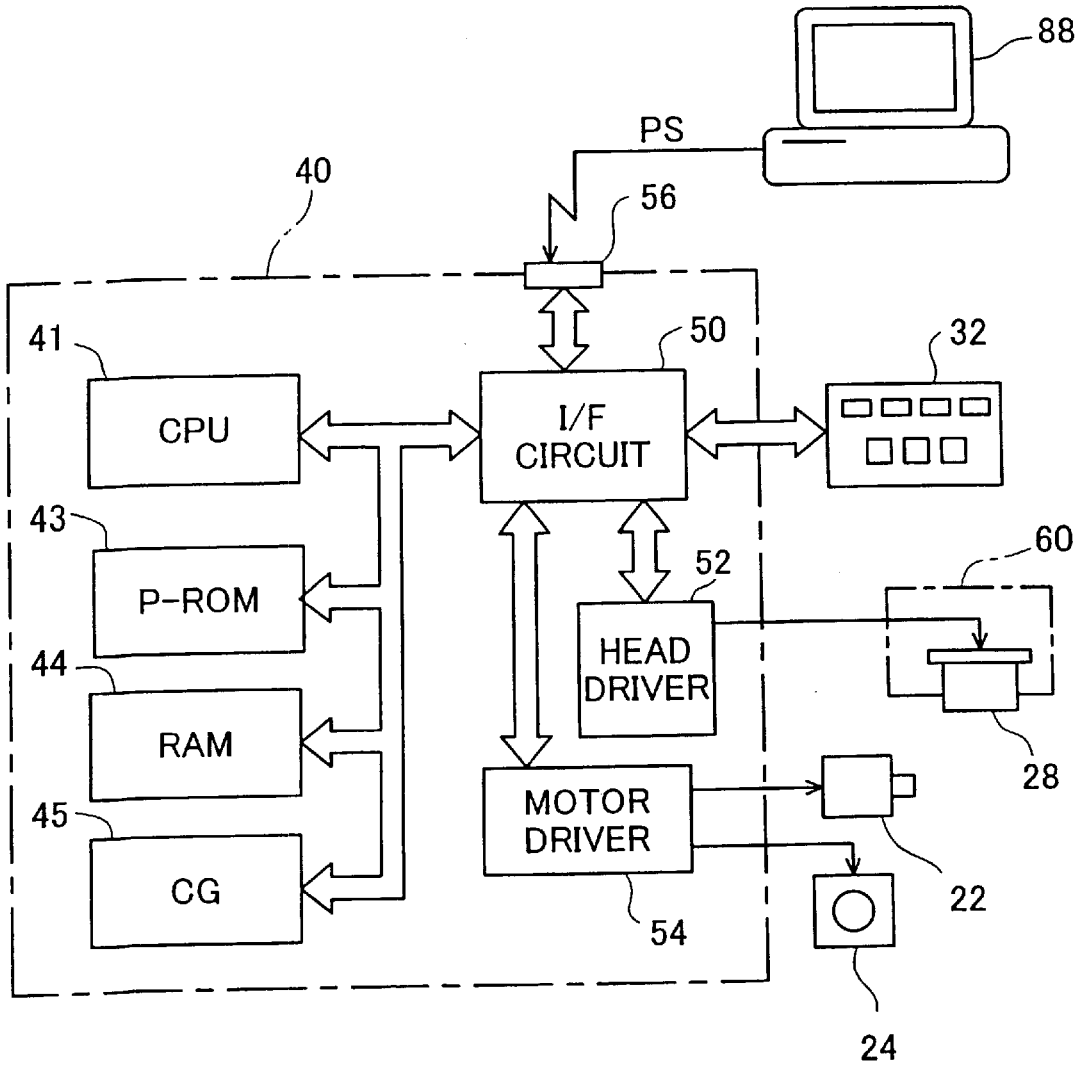
FIG. 2 is a block diagram showing the structure of a control circuit 40 included in the printer 20.

FIG. 2 is a block diagram showing the structure of the control circuit 40 included in the printer 20. The control circuit 40 is constructed as an arithmetic and logic operation circuit including a CPU 41, a programmable ROM (PROM) 43, a RAM 44, and a character generator (CG) 45 that stores dot matrixes of characters. The control circuit 40 further includes a dedicated I/F circuit 50 that dedicatedly works as an interface with external elements like a motor, a head driver 52 that connects with the dedicated I/F circuit 50 and drives the print head unit 60 to eject ink, and a motor driver 54 that drives the sheet feed motor 22 and the carriage motor 24. The dedicated I/F circuit 50 includes a parallel interface circuit and receives a print signal PS supplied from the computer 88 via the connector 56.

The following describes the structure of the print head unit 60. The print head unit 60 includes a housing in which an ink cartridge 70 for containing ink therein is housed, and a print head 28 that is a mechanism of ejecting ink droplets. The whole configuration including the print head 28 and the housing for the ink cartridge 70 is called the "print head unit 60", since the print head unit 60 is attached to and detached from the printer 20 as an unitary part. Namely replacement of the print head 28 requires placement of the print head print head unit 60.

Figure 3:
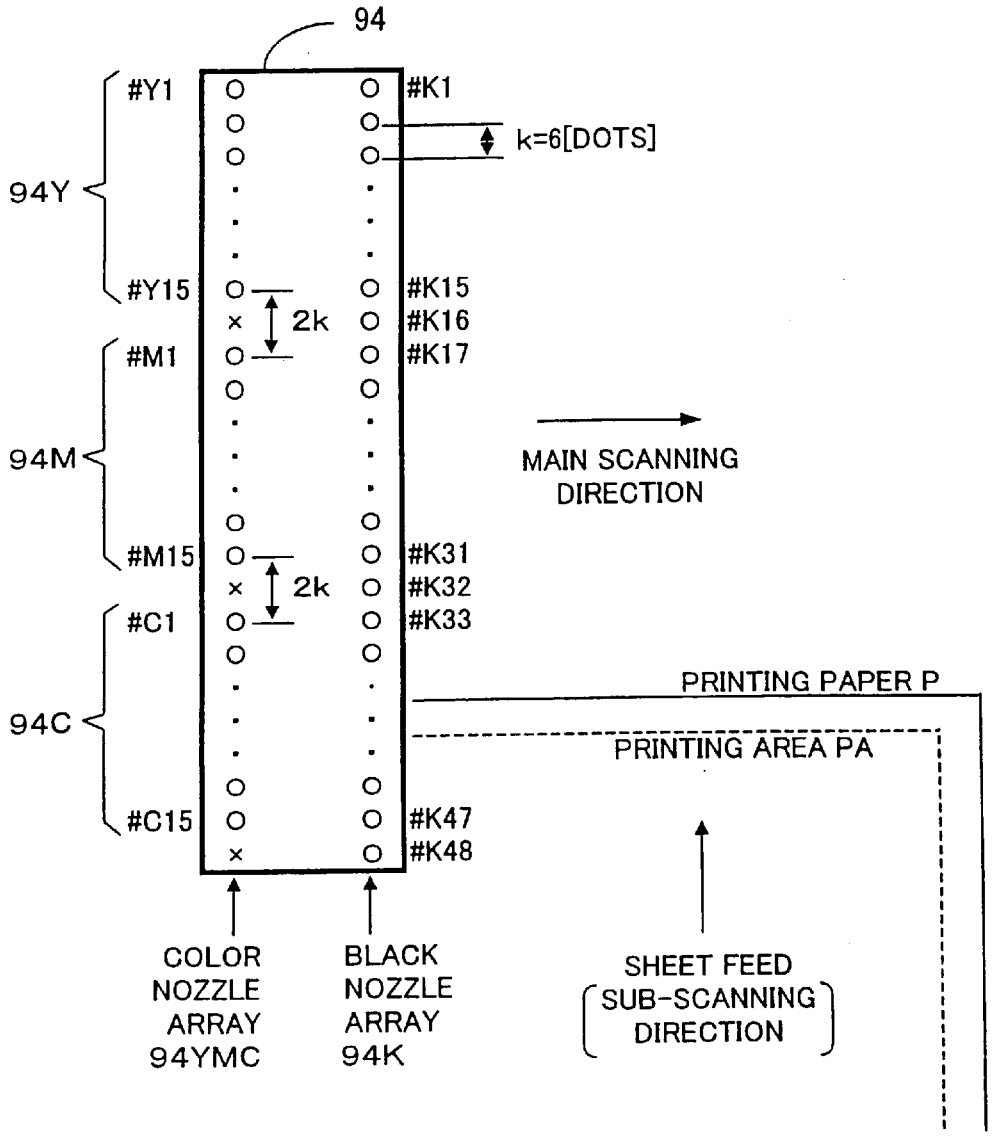
FIG. 3 shows an arrangement of nozzles formed on a bottom face of an actuator chip 94.

FIG. 3 shows an arrangement of nozzles formed on a bottom face of an actuator chip 94, which is disposed on a lower portion of the print head 28. A color nozzle array and a black nozzle array are formed on the bottom face of the actuator chip 94 and are respectively aligned in lines in the sub-scanning direction. The term "actuator" here means an ink ejection mechanism including nozzles and driving elements for ink ejection (for example, piezoelectric elements or heaters). A nozzle section in one actuator is generally molded as an integral ceramic part. Formation of two columns of nozzles in one actuator enables the highly accurate layout of nozzles and thereby improves the image quality. In the specification hereof, the "column of nozzles" is also be referred to as the "nozzle array".

The black nozzle array includes 48 nozzles #K1 through #K48. These nozzles #K1 through #K48 are arranged at a fixed nozzle pitch k in the sub-scanning direction. The nozzle pitch k is equal to 6 dots in this embodiment. The nozzle pitch k may be set to any other value that is obtained by multiplying the dot pitch on the printing medium P by an arbitrary integer of 2 or more.

The color nozzle array includes a yellow nozzle group 94Y, a magenta nozzle group 94M, and a cyan nozzle group 94C. In the specification hereof, the nozzle group of a colored ink is also referred to as the "chromatic nozzle group". The yellow nozzle group 94Y includes 15 nozzles #Y1 through #Y15. The pitch of these 15 nozzles is identical with the nozzle pitch k of the black nozzle array. This nozzle pitch k is also applied for the magenta nozzle group 94M and the cyan nozzle group 94C. A symbol "x" drawn between the lower end nozzle #Y15 of the yellow nozzle group 94Y and the upper end nozzle #M1 of the magenta nozzle group 94M represents no presence of a nozzle at the position. The interval between the lower end nozzle #Y15 of the yellow nozzle group 94Y and the upper end nozzle #M1 of the magenta nozzle group 94M is accordingly double the nozzle pitch k. This double nozzle pitch is also applied for the interval between the lower end nozzle #M15 of the magenta nozzle group 94M and the upper end nozzle #C1 of the cyan nozzle group 94C. In other words, the intervals between the respective nozzle groups of yellow, magenta, and cyan are set to be double the nozzle pitch k.

Each of the nozzles in the color nozzle groups 94Y, 94M, and 94C is located at an identical position in the sub-scanning direction with the corresponding nozzle of the black nozzle array 94K. There are, however, no colored ink nozzles at the positions corresponding to the $16^{th}$, $32^{nd}$, and $48^{th}$ nozzles #K16, #K32, and #K48 among the 48 nozzles #K1 through #K48 of the black nozzle array 94K.

In the course of printing, ink droplets are ejected from the respective nozzles while the print head 28 is moving in the main scanning direction together with the carriage 30 (see FIG. 1). In some printing procedures, all the nozzles are not always used, but only part of the nozzles may be used.

B. Principle of Correcting Misalignment of Recording Positions

The bidirectional printing creates dots in both the forward pass and the backward pass of the main scan to print one image on the printing medium P. Accordingly, when ink is ejected aiming at the same recording position on the forward pass and on the backward pass of printing, dots should actually be recorded at the same position on the printing medium P. This is because an image can be properly reproduced by combination of dots formed in the forward pass and dots formed in the backward pass only when ink aiming at the same recording position actually forms dots at the same position on the printing medium P.

As described previously, the recording positions in the main scanning direction may be misaligned on the forward pass and the backward pass of the main scan, due to a backlash of the driving mechanism in the main scanning direction or a warp of the platen that supports the printing medium thereon. This method of correcting the misalignment of recording positions intentionally shifts the ejection timings of ink droplets on the forward pass and on the backward pass from the "theoretical timings to record dots at the same recording position." This method accordingly absorbs the misalignment of recording positions and implements the correction, in order to ensure actual recording of dots at the same recording position.

Figure 4:
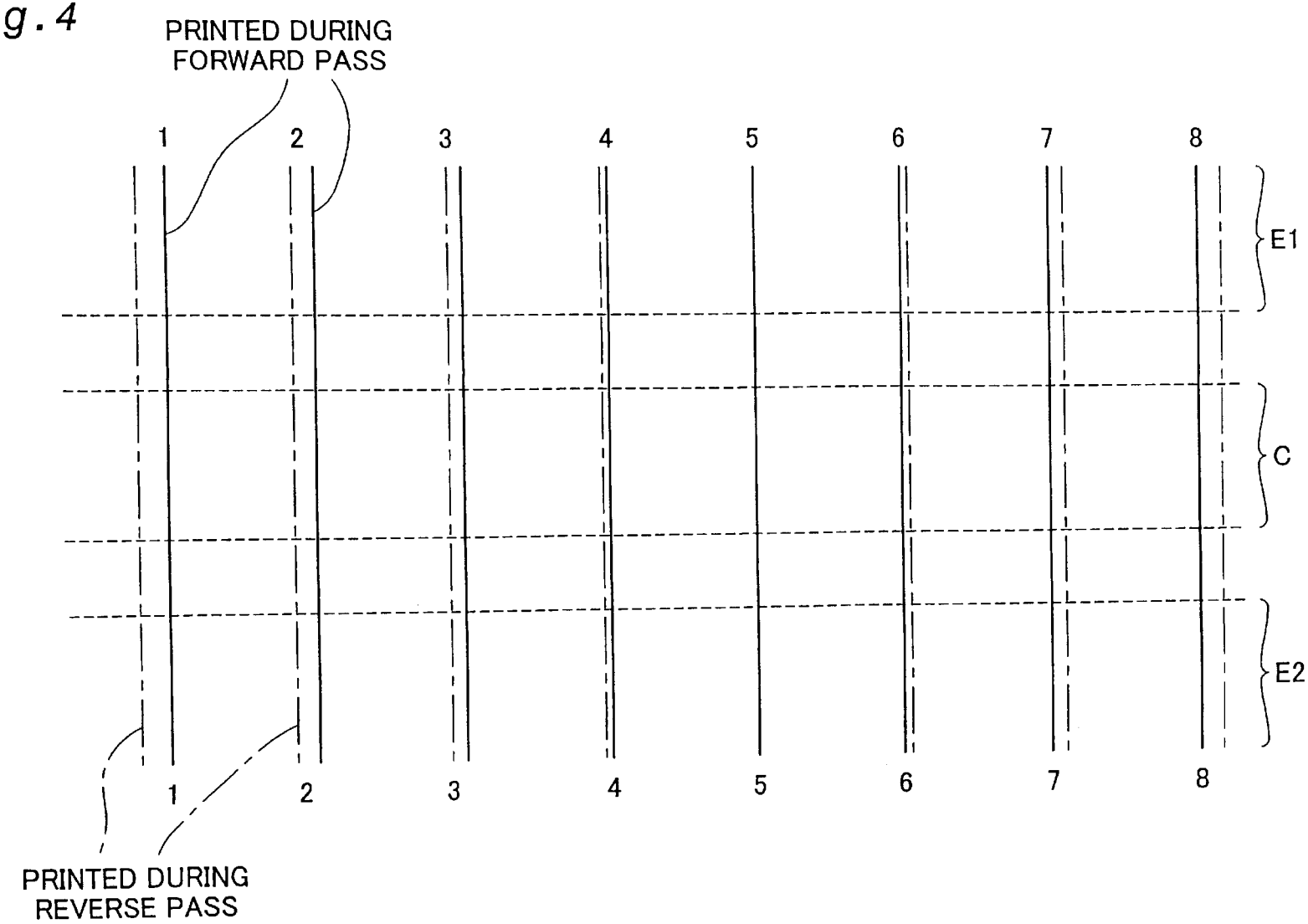
FIG. 4 shows the principle of determining a correction value for adjusting misalignment, based on a test pattern.

FIG. 4 shows the principle of determining a correction value for adjusting the misalignment based on a test pattern. The test pattern is printed by causing the black nozzles #K1 through #K48 to create dots on the printing medium P while the print head 28 is moving back and forth in the main scanning direction without any feed in the sub-scanning direction. On the forward pass, ink droplets are ejected to form ruled lines on the printing medium P at fixed intervals in the sub-scanning direction. In the example of FIG. 4, the solid lines with numerals 1 through 8 allocated thereto represent the ruled lines printed on the forward pass.

On the backward pass, the ruled line is printed at different timings, that is, at several different printing positions, so that user can select the "timing of recording a ruled line completely overlapping the ruled line recorded on the forward pass". In the example of FIG. 4, as a matter of convenience, the ruled lines printed on the backward pass are shown by the broken lines. In this example, the ruled line that is formed by ink droplets ejected on the backward pass at the "theoretical timing to record an identical ruled line" is the fourth left ruled line. The three left ruled lines from the third to the leftmost ruled line are printed at delayed ejection timings of ink droplets, so that those are formed on the backward pass slightly shifted leftward from the ruled lines formed on the forward pass. The four right ruled lines from the fifth to the rightmost ruled line are printed at advanced ejection timings of ink droplets, on the other hand, so that the ruled lines are formed on the backward pass slightly shifted rightward from those formed on the forward pass. This results in the test pattern printed on the printing medium P as shown in FIG. 4. The ruled lines Nos. 1 through 8 printed on the backward pass are shifted rightward sequentially from the left end by one dot pitch relative to the corresponding ruled lines printed on the forward pass. The correction value is accordingly set as an integral multiple of the dot pitch. This example shifts the ruled lines printed on the backward pass by one dot pitch. In the case where the printing position of the ruled line is shifted by a finer unit, the correction value can be set as an integral multiple of the finer unit. In the example of FIG. 4, the ruled lines formed on the backward pass are shown by the broken lines. This is only for the purpose of distinguishing the ruled lines formed on the backward pass from those formed on the forward pass and does not necessarily mean that the ruled lines are actually printed in broken line on the backward pass.

This procedure prints the ruled lines on the backward pass while varying the ejection timing of ink droplets to a plurality of different patterns in both the advancing and delaying directions from the theoretical value. On the theoretical basis, the fourth left ruled line formed on the backward pass is expected to be coincident with the ruled line formed on the forward pass. In the actual state, however, as shown in FIG. 4, the fifth left ruled line formed on the backward pass (at the slightly advanced ejection timing of ink droplets relative to the theoretical timing) is coincident with the ruled line formed on the forward pass. The ejection timing of ink droplets applied to form the fifth left ruled line enables dots to be actually recorded at the same position when ink is ejected aiming at the same recording position in both the forward pass and the backward pass. This timing is stored as the correction value and is applied for actual printing. This arrangement ensures the adequate correction of the recording positions.

This procedure of correction does not always require all the nozzles in the nozzle array to be used for printing as discussed in FIG. 4. Only part of the nozzles in the nozzle array may be used to print the ruled lines, as long as it can determine whether or not the ruled lines drawn on the forward pass and on the backward pass form a single straight line. For example, only one of an upper end part E1, a center part C, and a lower end part E2 of the ruled line shown in FIG. 4 may be printed with the corresponding part of nozzles as the test pattern. This modified procedure advantageously saves the quantity of ink required for printing the test pattern.

Figure 5:
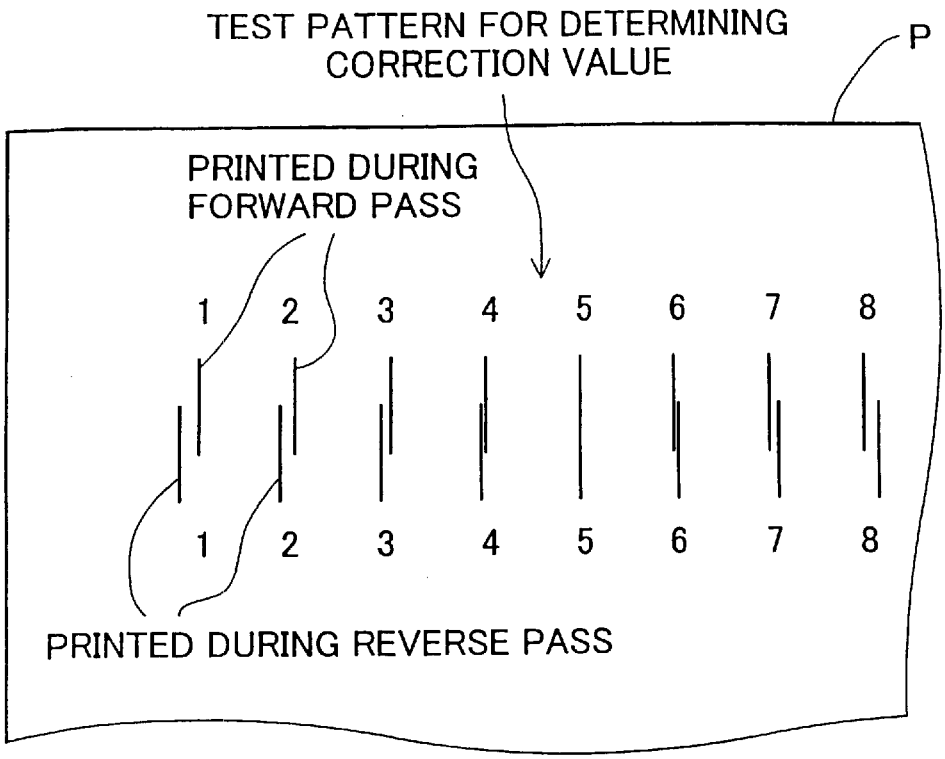
FIG. 5 shows the printing results of the test pattern wherein only a part E1 of the ruled line shown in FIG. 4 is printed in such a manner that the printing position in a backward pass of main scan is shifted from that in a forward pass in a sub-scanning direction.

The procedure of FIG. 4 prints the ruled lines overlapped on the forward pass and on the backward pass. In the modified procedure, however, it is preferable to move the print head 28 in the sub-scanning direction and thereby shift the printing position of the ruled line on the backward pass from that on the forward pass. FIG. 5 shows the printing results of the test pattern wherein only the part E1 of the ruled line shown in FIG. 4 is printed in such a manner that the printing position on the backward pass is shifted from that on the forward pass in the sub-scanning direction. As clearly understood from FIG. 5, the method, which shifts the printing position of the ruled line on the backward pass from that on the forward pass in the sub-scanning direction, facilitates the determination of the degree of coincidence of the two ruled lines. In the example of FIG. 5, all the ruled lines formed in both the forward pass and on the backward pass are shown by the solid lines.

The test pattern is not restricted to the vertical lines but may be any linear pattern where dots are recorded intermittently.

Figure 6:
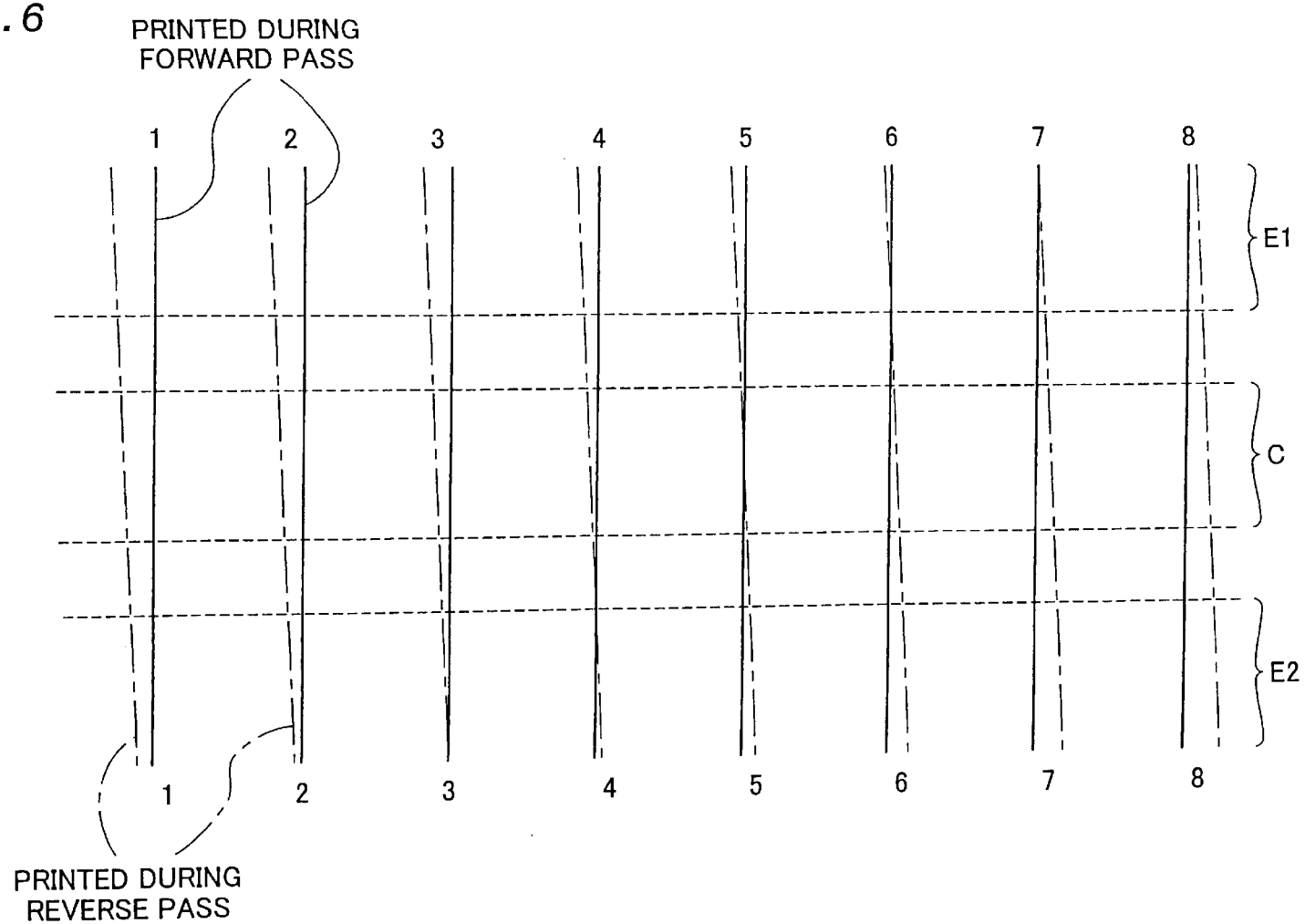
FIG. 6 shows the printing results of the test pattern with all the nozzles in the nozzle array when the inclination of the nozzle array on the backward pass is different from that on the forward pass.

C. Principle of Correcting Misalignment of Recording Positions in Structure where Inclination of Print Head in Backward Pass is Different from that in Forward Pass In the case where the print head 28 moves back and forth while keeping the orientation of the nozzle array perpendicular to the main scanning direction, the test pattern of FIG. 5 using only the nozzles in the upper end part of the nozzle array ensures the accurate determination of the correction value. In some cases, for example, due to the backlash of the driving mechanism in the main scanning direction, however, the nozzle array can not keep the orientation perpendicular to the main scanning direction but may have different inclinations on the forward pass and on the backward pass. In such cases, the procedure of printing the test pattern corresponding to FIG. 4 on the forward pass and on the backward pass gives the results of FIG. 6. FIG. 6 shows the printing results of the test pattern with all the nozzles in the nozzle array when the inclination of the nozzle array on the backward pass is different from that on the forward pass.

Figure 7:
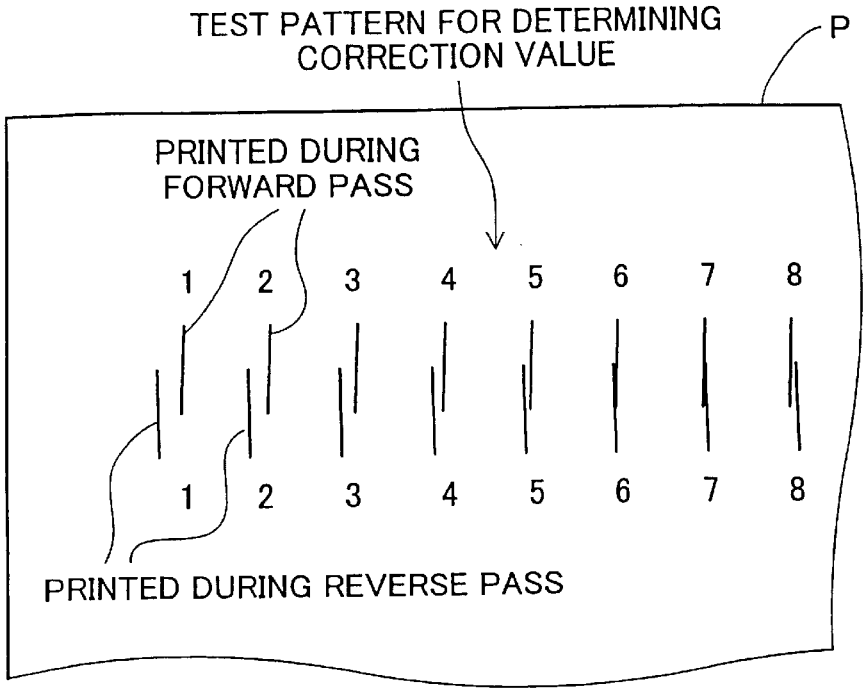
FIG. 7 shows the printing results of the test pattern with only the nozzles in an upper end part of the nozzle array when the inclination of the nozzle array on the backward pass is different from that on the forward pass.

In such cases, the procedure of printing the test pattern corresponding to FIG. 5 with part of the nozzles which create the dots of the upper end part E1 in the ruled line shown in FIG. 6 would give the results of FIG. 7. In the results of FIG. 7, either the sixth left ruled lines or the seventh left ruled lines are closest to a single straight line. When the correction value for printing is determined based on the test pattern of FIG. 7, the ejection timing of ink droplets is thus regulated to either the timing of the sixth left ruled lines or the seventh left ruled lines.

As clearly understood from the test pattern of FIG. 6 printed with all the nozzles in the nozzle array, however, the printing result at either the timing of the sixth left ruled lines or the timing of the seventh left ruled lines has a relatively large misalignment of recording positions with regard to the lower end part E2 in the ruled line, while having a small misalignment of recording positions with regard to the upper end part E1. Namely this procedure does not attain the optimum correction for the whole nozzle array. When the test pattern is printed with part of the nozzles which create the dots of the lower end part E2 in the ruled line shown in FIG. 6, on the other hand, either the third left ruled lines or the fourth left ruled lines would be selected as the optimum timing. In this case, a relatively large misalignment of recording positions is observed with regard to the upper end part E1.

Figure 8:
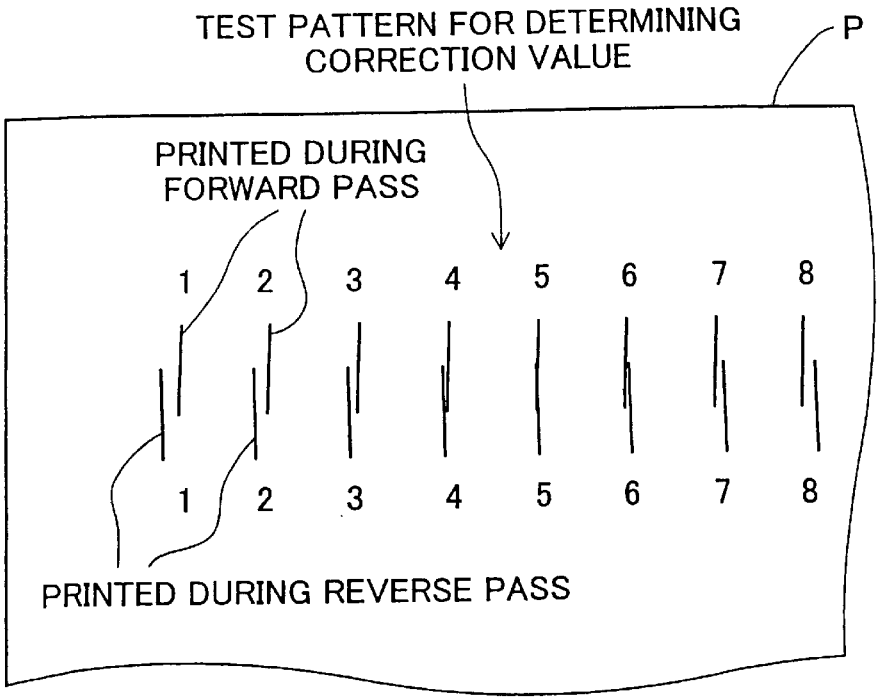
FIG. 8 shows the printing results of the test pattern with only the nozzles in a center part of the nozzle array when the inclination of the nozzle array on the backward pass is different from that on the forward pass.

The procedure of printing the test pattern corresponding to FIG. 5 using part of the nozzles which create dots of the center part C in the ruled line shown in FIG. 6 gives the results of FIG. 8. In the results of FIG. 8, the fifth left ruled lines are closest to a single straight line. When the correction value for printing is determined based on the test pattern of FIG. 8, the ejection timing of ink droplets is thus regulated to the timing of the fifth left ruled lines. As clearly understood from the test pattern of FIG. 6 printed with all the nozzles in the nozzle array, in the case of the fifth left ruled lines, the optimum correction is attained for the whole nozzle array. In this case, neither the upper end part E1 nor the lower end part E2 is widely deviated as the other part, but both the upper end part E1 and the lower end part E2 equally have relatively small deviations. In the procedure of the embodiment, the correction value, which is used to correct the misalignment of recording positions in the main scanning direction on the forward pass and the backward pass, is determined with regard to a representative nozzle sub-array consisting of nozzles that are within a predetermined range in the vicinity of the center of the nozzle array.

D. First Embodiment

Figure 9:
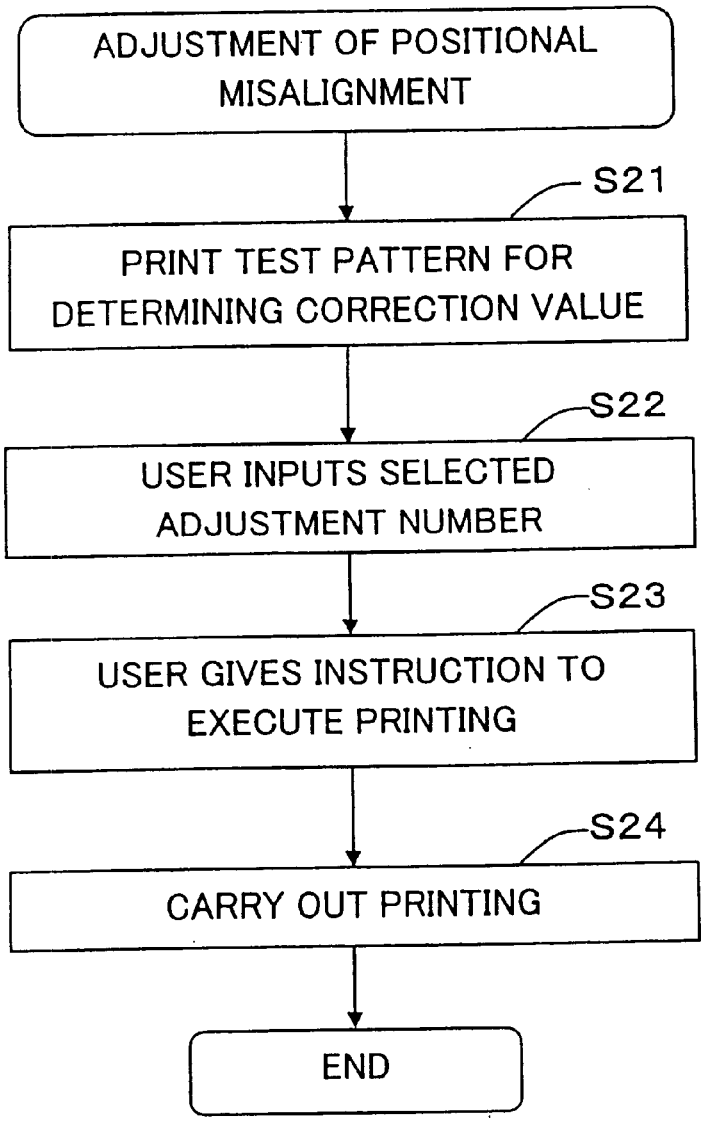
FIG. 9 is a flowchart showing a procedure of determining the correction value based on the test pattern.

FIG. 9 is a flowchart showing a procedure of adjusting the positional misalignment. This adjustment is performed by the user in principle. At step S21, a test pattern for determining the correction value (positional misalignment test pattern) as shown in FIG. 8 is printed with the printer 20. The method of printing the test pattern is described in the section "C. Principle of Correcting Misalignment of Recording Positions in Structure where Inclination of Print Head in Backward Pass is Different from that in Forward Pass".

In the process of printing the test pattern, numerals representing misalignment adjustment numbers (Nos. 16 to 8 in FIGS. 4 through 8) are actually printed above and below plural sets of vertical ruled lines. The misalignment adjustment numbers have the function as the correction information representing the favorable correction state. Here the expression of "favorable correction state" means the state giving a minimum positional misalignment of dots in the main scanning direction formed by the forward pass and by the backward pass, when the recording position (or the recording timing) of either the forward pass or the backward pass is corrected with a proper correction value. In the description above, the misalignment adjustment numbers increase in an ascending order from the leftmost end. Any numbers may be, however, allocated as long as the correction state can be specified.

In the step S22, the user observes the test pattern shown in FIG. 8 and inputs the misalignment adjustment number allocated to the set of vertical ruled lines having the minimum positional misalignment on a user interface window (not shown) of the printer driver in the computer 88 (see FIG. 2). The input misalignment adjustment number is stored into the P-ROM 43 of the printer 20.

This series of procedure is carried out not only for the black nozzle array 94K but for the color nozzle array 94YMC. Namely the P-ROM 43 of the printer 20 stores via the computer 88 (FIG. 2) a first adjustment number representing a first correction value with regard to the color nozzle array 94YMC and a second adjustment number representing a second correction value with regard to the black nozzle array 94K. The color nozzles are arrayed in the sub-scanning direction in the sequence of the cyan nozzle group 94C, the magenta nozzle group 94M, and the yellow nozzle group 94Y as mentioned previously. The central magenta nozzle group 94M is used for printing the test pattern.

Figure 10:
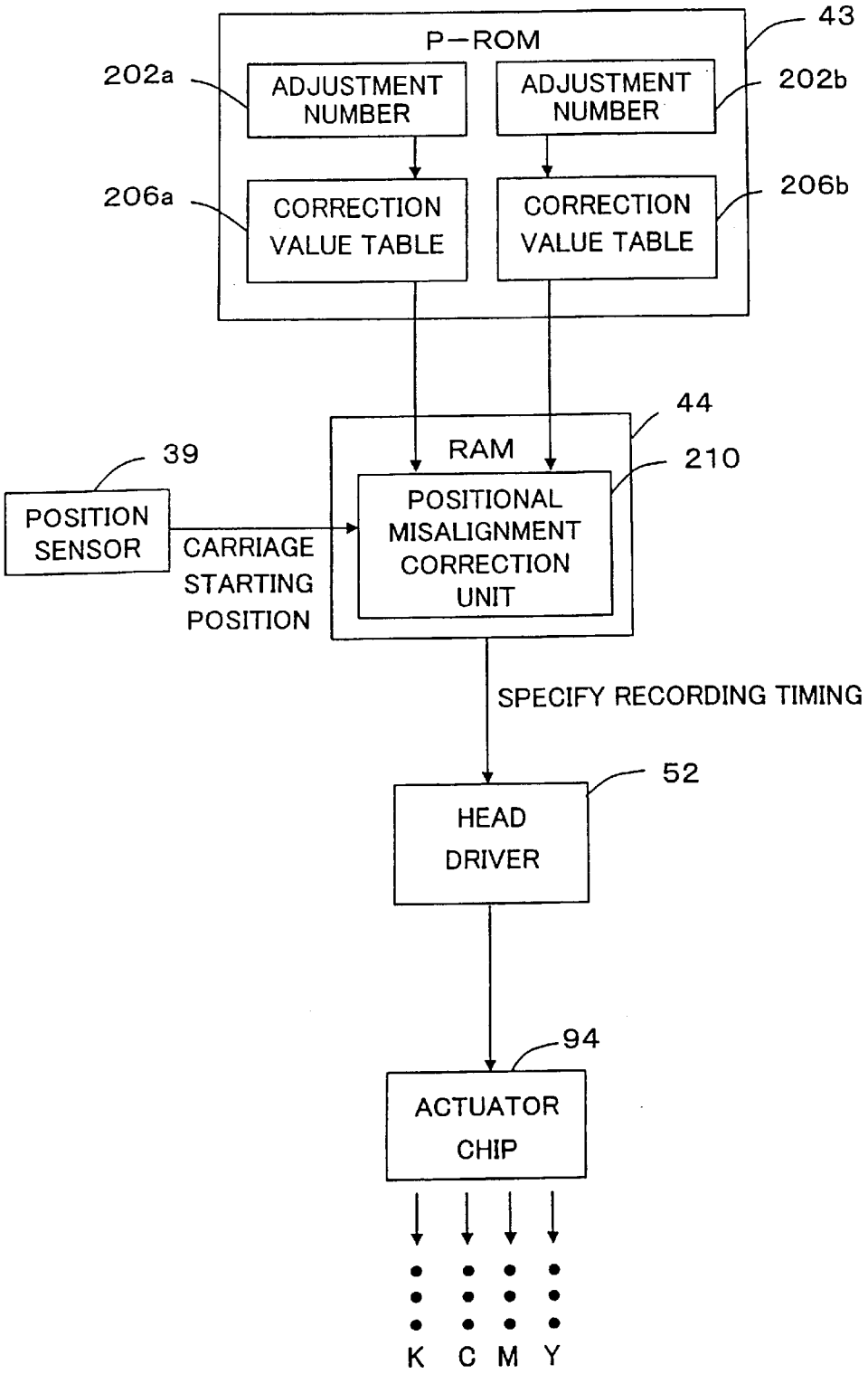
FIG. 10 is a block diagram illustrating the main configuration relating to the correction of misalignment in the course of bidirectional printing in the first embodiment.

At step S23, when the user gives an instruction to execute printing. Then, at step S24, bidirectional printing is actually carried out while the positional misalignment is corrected with the correction value. FIG. 10 is a block diagram illustrating the main configuration relating to the correction of misalignment in the course of bidirectional printing in the first embodiment. The P-ROM 43 in the printer 20 includes adjustment number storage areas 202*a* and 202*b* and correction value tables 206*a* and 206*b*. The first misalignment adjustment number is stored in the adjustment number storage area 202*a*, and the second misalignment adjustment number is stored in the adjustment number storage area 202*b*. Each of the correction value tables 206*a* and 206*b* stores the mapping of the misalignment adjustment numbers to the amounts of misalignment (that is, the correction values) of the recording position of the vertical ruled line formed by the backward pass in the test pattern shown in FIG. 8.

The RAM 44 of the printer 20 stores a computer program having the function of a positional misalignment correction unit 210 to correct the positional misalignment in the course of bidirectional printing. The positional misalignment correction unit 210 reads the correction values corresponding to the selected misalignment adjustment numbers from the correction value tables 206*a* and 206*b* in the P-ROM 43. On the backward pass, the positional misalignment correction unit 210 receives a signal representing the starting position of the carriage 30 from the position sensor 39 (FIG. 1) and calculates the average of the first correction value and the second correction value as a mean correction value. In the case of color printing, the positional misalignment correction unit 210 supplies a signal for specifying the recording timing of the print head to the head driver 52 according to the mean correction value. The head driver 52 sends the driving signal to the actuator chip 94 and adjusts the recording position on the backward pass to the specified recording timing transmitted from the positional misalignment correction unit 210. This causes the recording positions of both the black nozzle array and the color nozzle array to be adjusted with the common mean correction value. In the printing apparatus of the embodiment, the black nozzles as well as the color nozzles are used for color printing.

In the case of monochromatic printing that does not use any color inks, it is preferable to correct the positional misalignment with only the second correction value. In a preferable application, when the computer 88 (FIG. 1) informs the control circuit 40 of monochromatic printing, the control circuit 40 of the printer 20 (more specifically, the positional misalignment correction unit 210 shown in FIG. 10) thus corrects the positional misalignment in the course of bidirectional printing with only the second correction value.

As described above, the correction value, which is used to correct the positional misalignment in the course of bidirectional printing, is established using the center nozzle part of the nozzle array as a reference, and actually corrects the positional misalignment in the course of bidirectional printing with the correction value. Even when there is a difference in inclination of the nozzle array in the main scanning direction between the forward pass and the backward pass, this arrangement ensures the adequate correction for the whole nozzle array, thereby improving the print image quality.

In the case of color printing, the correction is carried out with the mean of the respective correction values for the color nozzle array and the black nozzle array (that is, the first correction value and the second correction value). In the case of monochromatic printing, on the other hand, the correction is carried out with only the correction value for the black nozzle array (that is, the second correction value). This arrangement ensures the optimum corrections in the respective print modes.

In the structure of this embodiment, the color nozzles are arrayed in the sub-scanning direction in the sequence of the cyan nozzle group 94C, the magenta nozzle group 94M, and the yellow nozzle group 94Y. The central magenta nozzle group 94M is used for printing the test pattern. The correction is accordingly made to minimize the misalignment of recording positions of dots with regard to magenta. The misalignment of recording positions in magenta is more conspicuous than that in yellow. The yellow nozzle group 94Y, where the misalignment of recording positions in yellow is relatively inconspicuous, is allocated to one of the end parts that has the greater degree of misalignment of recording positions of dots than the center part. The misaligned recording position of the end part is accordingly not prominent. This arrangement makes the total misalignment of recording positions of dots sufficiently inconspicuous and thereby prevents deterioration of the image quality. In the structure of the embodiment, the magenta nozzles are used as the representative color nozzle sub-array to print the test pattern. The representative color nozzle sub-array is, however, not restricted to the magenta nozzles. The cyan nozzles ensure the same effects as long as the cyan nozzles are located within the predetermined range in the neighborhood of the center of the nozzle array. The yellow nozzles may also be used as the representative color nozzle sub-array to correct the misalignment of recording positions.

In the structure of the embodiment, the representative nozzle sub-array used to print the test pattern includes nozzles located in the part C shown in FIG. 6 among all the nozzles in the nozzle array. The representative nozzle sub-array is, however, not restricted to this part C. For example, the representative nozzle sub-array may be a sequence of nozzles that includes a specific nozzle closest to the center position along the nozzle array and consists of approximately half of all the nozzles in the nozzle array. More preferably the representative nozzle sub-array is a sequence of nozzles consisting of approximately one third of all the nozzles in the nozzle array. The representative nozzle sub-array is not required to have equal nozzles along the length of the nozzle array from the center position of the nozzle array. The representative nozzle sub-array may be a group of nozzles that are located within a predetermined range in the neighborhood of the center of the nozzle array. In other words, the representative nozzle sub-array includes the specific nozzle closest to the center position along the nozzle array but does not include end nozzles on either end of the nozzle array.

In the case of color printing, the technique of the embodiment carries out the correction with the simple arithmetic mean (average) of the respective correction values of the color nozzle array and the black nozzle array (that is, the first correction value and the second correction value). The calculation of the mean correction value is not restricted to this method, but the mean correction value may be a weighted average of the first correction value and the second correction value. This procedure may give weights to the first correction value and the second correction value by taking into account the frequency of use of the color inks, yellow, cyan, and magenta, and the black ink, the distance from the center of the nozzle array, and the degree of conspicuousness of the misaligned recording position, and may calculate the weighted average to obtain the mean correction value. The technique of the embodiment carries out the correction with the mean of the first correction value and the second correction value in color printing. When black nozzles are not used so often in color printing, the correction may be carried out with only the correction value for the color nozzle array (that is, the first correction value) in color printing. Namely the misalignment of recording positions in the main scanning direction may be corrected in the course of bidirectional printing based on the first and the second correction values, without limitation on the way of the use of the first and the second correction values. The procedure of using the mean value of the first correction value and the second correction value as discussed in the above embodiment is suitable for the correction when black nozzles are used in color printing.

Figure 11A:
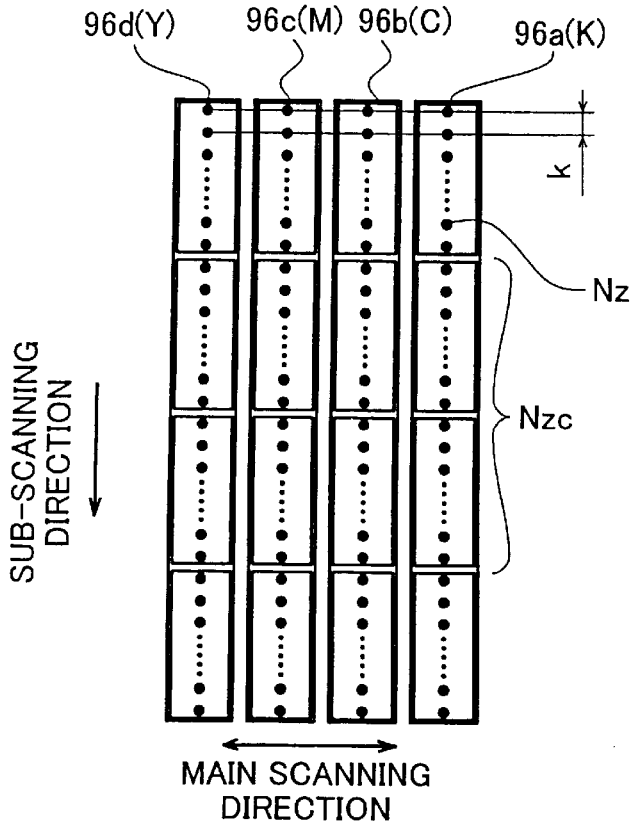
FIGS. 11(*a*) and 11(*b*) show a print heads having head assemblies where a plurality of nozzle units are arranged in the sub-scanning direction.
Figure 11B:
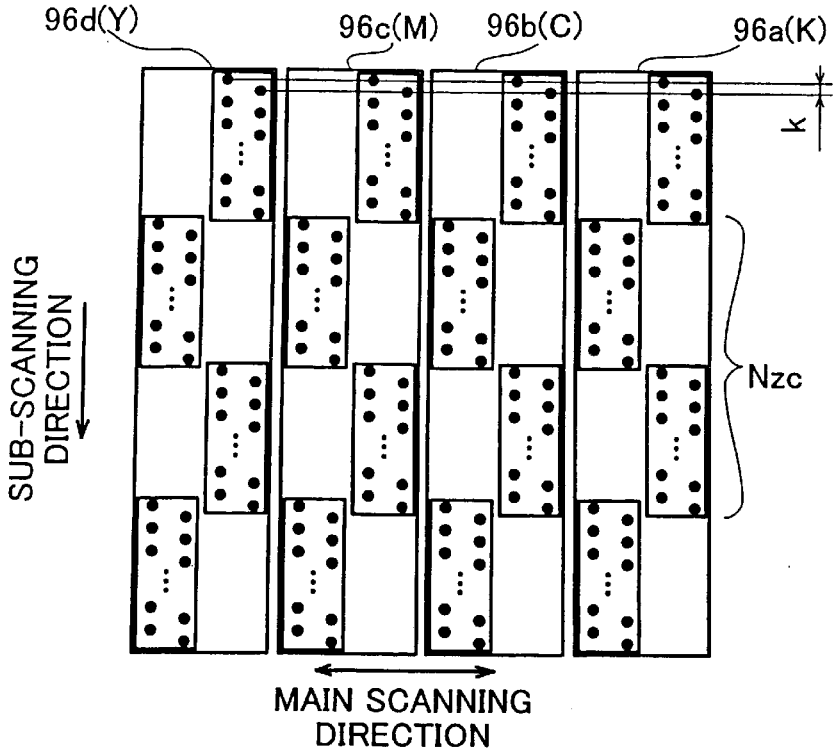

In this embodiment, the misalignment of recording positions is corrected in the printing apparatus having the print head unit 60 where one actuator controls 48 nozzles arrayed in the sub-scanning direction as shown in FIG. 3. The technique of correcting the misalignment of recording positions according to the present invention is, however, not restricted to the printing apparatus of this structure. As shown in FIGS. 11(*a*) and 11(*b*), the technique of the present invention is applicable to another printing apparatus where a plurality of actuators are aligned in the sub-scanning direction and a large number of nozzles Nz are arranged in the sub-scanning direction. The print heads unit shown in FIGS. 11(*a*) and (*b*) have head assemblies 96*a* through 96*d*, where each head assembly includes a plurality of nozzle units arrayed in the sub-scanning direction. The head assemblies 96*a* through 96*d* respectively eject the color inks of black (K), cyan (C), magenta (M), and yellow (Y). In the print head unit of this structure, the representative nozzle sub-array consists of nozzles Nzc that are located in a, predetermined range in the vicinity of the center of the nozzle array, which extends in the sub-scanning direction on the head assembly. The procedure prints the positional misalignment test pattern on the printing medium with the representative nozzle sub-array, determines the correction value, and corrects the misalignment of recording positions with the correction value. Since a long nozzle array extends in the sub-scanning direction, even a minute declination of the nozzle array results in a significant positional misalignment on both ends of the nozzle array. The technique of correcting the misalignment of recording positions according to the present invention is especially effective for the printing apparatus of such structure. The printing apparatus having such a nozzle arrangement enables a large number of dots to be simultaneously created by one pass of the main scan and accordingly has the advantage of the high printing speed.

E. Second Embodiment

Figure 12:
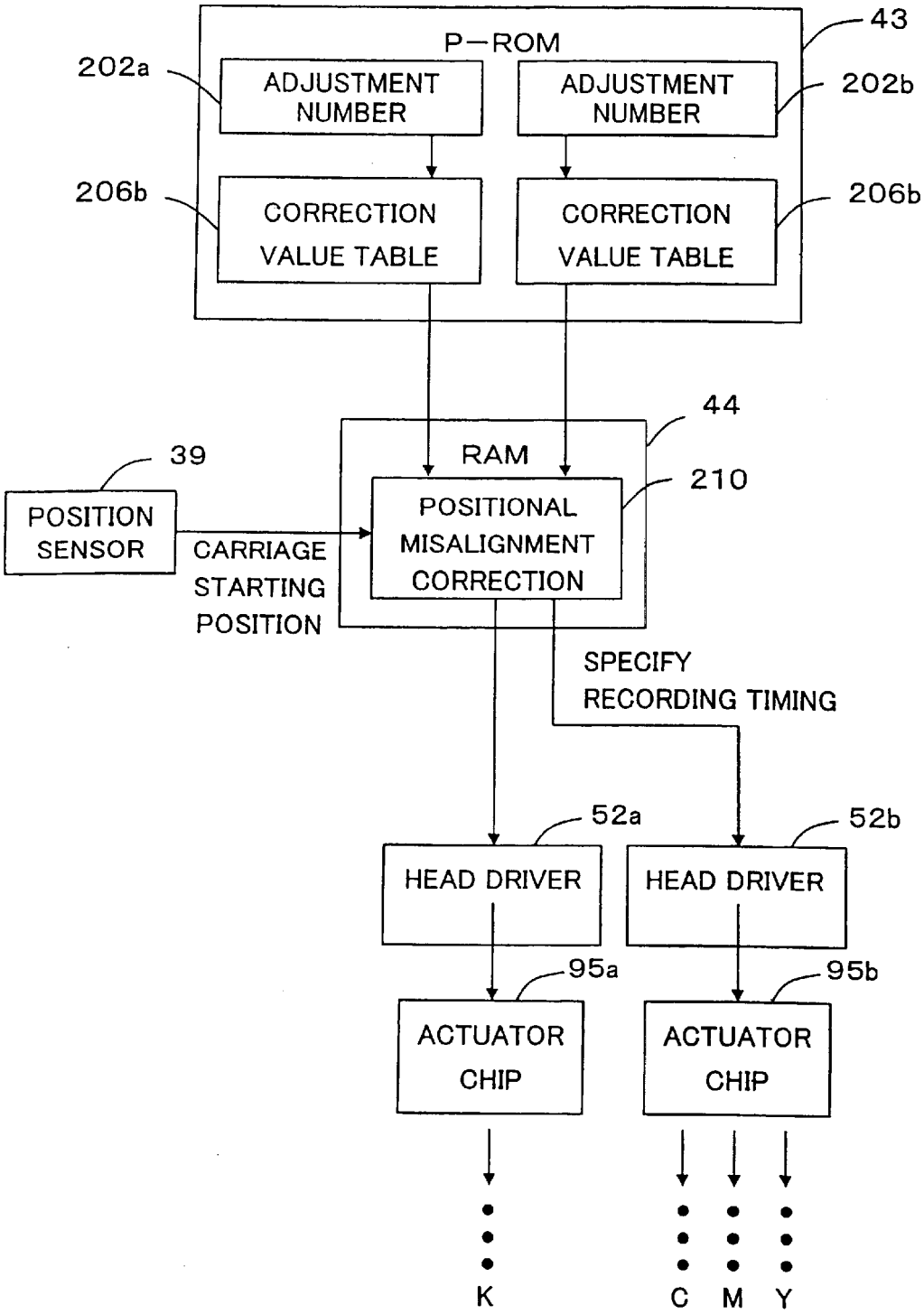
FIG. 12 is a block diagram illustrating the main configuration relating to the correction of misalignment in the course of bidirectional printing in a second embodiment.

FIG. 12 is a block diagram illustrating the main configuration relating to the correction of misalignment in the course of bidirectional printing in a second embodiment. The difference from the structure shown in FIG. 10 is that an actuator chip 95*a* causing the black nozzle array to eject the black ink is separate from an actuator chip 95*b* causing the color nozzle array to eject the cyan, magenta, and yellow inks and that a head driver 52*a* for driving the actuator chip 95*a* is separate from a head driver 52*b* for driving the actuator chip 95*b*. Namely the two head drivers 52*a* and 52*b* independently drive the respective actuator chips 95*a* and 95*b*. In this structure, the positional misalignment correction unit 210 gives the specified recording timings independently to the respective head drivers 52*a* and 52*b*. The positional misalignment in the course of bidirectional printing is accordingly carried out for each actuator chip.

The feature of the second embodiment is that the correction value is set independently for each actuator chip. The arrangement of correcting the positional misalignment for each actuator chip ensures the finer correction with regard to each nozzle group or groups in the same actuator chip, thus further reducing the positional misalignment in the course of bidirectional printing.

The recording position of dots depends on a variation in ejection speed of ink droplets ejected from the nozzle array. Namely the variation in ejection speed of ink droplets results in shifting the recording position of dots. The variation in ejection speed of ink droplets ejected from each nozzle array depends upon a variety of factors given below:

(1) the manufacturing error of each actuator chip;

(2) the physical properties of ink (for example, the viscosity); and (3) the weight of ink droplets.

If the main factor of the variation in ejection speed of ink droplets is the manufacturing error of each actuator chip, the ink droplets ejected from the same actuator have a substantially equal ejection speed. In this case, it is preferable to correct the misalignment of recording positions in the main scanning direction with regard to each of nozzle array groups that are driven by different actuator chips respectively.

If the physical properties of ink and the weight of ink droplets also significantly affect the ejection speed of ink droplets, it is preferable to correct the misalignment of recording positions of dots in the main scanning direction with regard to each ink or with regard to each nozzle array.

The present invention is not restricted to the above embodiments or their modifications, but there may be many other modifications, changes, and alterations without departing from the scope or spirit of the main characteristics of the present invention. Some examples of possible modification are given below.

(1) It is preferable to set the correction value independently for each nozzle group for which the ejection timing of ink droplets can be corrected independently. This arrangement further reduces the positional misalignment, compared with the arrangement of the embodiment discussed above. The correction value may be set independently for each nozzle array that ejects the same ink. For example, when two nozzle arrays eject the same specific ink, an identical correction value is applied for the two nozzle arrays.

(2) The technique of the embodiment adjusts the recording target position of dots (or the recording timing) in order to correct the positional misalignment. Other methods may be applied to correct the positional misalignment. One applicable procedure adjusts the frequency of the driving signal transmitted to the actuator chip to correct the positional misalignment.

(3) The technique of the embodiment adjusts the recording target position (or the recording timing) on the backward pass to correct the positional misalignment. One modified procedure adjusts the recording target position on the forward pass to correct the positional misalignment. Another modified procedure adjusts both the recording target positions on the forward pass and on the backward pass to correct the positional misalignment. In general, the positional misalignment is corrected by adjusting at least one of the recording target positions on the forward pass and on the backward pass.

(4) Although ink jet printers are described in the above embodiments, the present invention is not restricted to the ink jet printers but may be applicable to a variety of printing apparatuses that generally carry out printing with a print head.

What is claimed is:

1. A printing apparatus that carries out bidirectional, reciprocating main scan and prints on a printing medium, the printing apparatus comprising:

a print head having a color nozzle array which is arranged in a sub-scanning direction and comprises a plurality of nozzle sub-arrays each of which ejects ink droplets in one color to record dots on the printing medium;

a memory that stores a color correction value for correcting misalignment of recording positions of the color nozzle array in a main scanning direction on a forward pass and a backward pass of the main scan; and a positional misalignment correction unit that corrects using the color correction value the misalignment of recording positions of the color nozzle array in the main scanning direction occurring in bidirectional printing, wherein the plurality of nozzle sub-arrays include a representative color nozzle sub-array which is within a predetermined range around a center of the color nozzle array, and the color correction value is determined according to correction information that represents a favorable correction state selected based on a color positional misalignment test pattern, the color positional misalignment test pattern being printed on a printing medium with the representative color nozzle sub-array and without another nozzle array which ejects ink droplets in one color and is beyond the predetermined range.

2. printing apparatus in accordance with claim 1, wherein the plurality of nozzle sub-arrays comprise:

a yellow nozzle sub-array configured to eject yellow ink;

a cyan nozzle sub-may configured to eject cyan ink; and a magenta nozzle sub-array configured to eject magenta ink, and the representative color nozzle sub-array is selected from one of the cyan nozzle sub-array and the magenta nozzle sub-array.

3. A printing apparatus that carries out bidirectional, reciprocating main scan and prints on a printing medium, the printing apparatus comprising:

a print head having a color nozzle array which is arranged in a sub-scanning direction and comprises a plurality of nozzle sub-array each of which ejects ink droplets in one color to record dots on the printing medium;

a memory that stores a color correction value for correcting misalignment of recording positions of the color nozzle array in a main scanning direction on a forward pass and a backward pass of the main scan; and a positional misalignment correction unit that corrects using the color correction value the misalignment of recording positions of the color nozzle array in the main scanning direction occurring in bidirectional printing, wherein the plurality of nozzle sub-arrays include a representative color nozzle sub-array which is within a predetermined range around a center of the color nozzle array, and represents a favorable correction state selected based on a color positional misalignment test pattern, the color positional misalignment test pattern being printed on a printing medium with the representative color nozzle sub-array, wherein the print head comprises a plurality of color nozzle arrays, the memory stores a plurality of color correction values each of which is determined based on the color positional misalignment test pattern printed with each of the representative color nozzle sub-arrays included in each of the plurality of color nozzle arrays, and the positional misalignment correction unit corrects the misalignment of recording positions of the plurality of color nozzle arrays in the main scanning direction occurring in bidirectional printing using a mean value of the plurality of color correction values.

4. A printing apparatus that carries out bidirectional, reciprocating main scan and prints on a printing medium, the printing apparatus comprising:

a print head having a color nozzle array which is arranged in a sub-scanning direction and comprises a plurality of nozzle sub-arrays each of which ejects ink droplets in one color to record dots on the printing medium;

a memory that stores a color correction value for correcting misalignment of recording positions of the color nozzle array in a main scanning direction on a forward pass and a backward pass of the main scan; and a positional misalignment correction unit that corrects using the color correction value the misalignment of recording positions of the color nozzle array in the main scanning direction occurring in bidirectional printing, wherein the plurality of nozzle sub-arrays include a representative color nozzle sub-array which is within a predetermined range around a center of the color nozzle array, and the color correction value is determined according to correction information that represents a favorable correction state selected based on a color positional misalignment test pattern, the color position misalignment test pattern being printed on a printing medium with the representative color nozzle sub-array, wherein the print head comprises a first color nozzle array and a second color nozzle array, the memory stores:

a first color correction value for correcting misalignment of recording positions of the first color nozzle array which is determined based on a first color positional misalignment test pattern printed with a first representative color nozzle sub-ray which is included in the first color nozzle array and is within a predetermined range around a center of the first color nozzle array, a second color correction value for correcting misalignment of recording positions of the second color nozzle array which is determined based on a second color positional misalignment test pattern printed with a second representative color nozzle sub-array which is included in the second color nozzle array and is within a predetermined range around a center of the second color nozzle array, and the positional misalignment correction unit:

corrects misalignment of recording positions of the first color nozzle array in the main scanning direction using the first color correction value, and corrects misalignment of recording positions of the second color nozzle array in the main scanning direction using the second color correction value.

5. A printing apparatus that carries out bidirectional, reciprocating main scan and prints on a printing medium, the printing apparatus comprising:

a print head having a color nozzle array which is arranged in a sub-scanning direction and comprises a plurality of nozzle sub-arrays each of which ejects ink droplets in one color to record dots on the printing medium;

a memory that stores a color correction value for correcting misalignment of recording positions of the color nozzle array in a main scanning direction on a forward pass and a backward pass of the main scan; and a positional misalignment correction unit that corrects using the color correction value the misalignment of recording positions of the color nozzle array in the main scanning direction occurring in bidirectional printing, wherein the plurality of nozzle sub-arrays include a representative color nozzle sub-array which is within a predetermined range around a center of the color nozzle array, and the color correction value is determined according to correction information that represents a favorable correction state selected based on a color positional misalignment test pattern, the color positional misalignment test pattern being printed on a printing medium with the representative color nozzle sub-array, wherein the print head further comprises a black nozzle array which is arranged in the sub-scanning direction and ejects black ink droplets to record dots on the printing medium, the memory further stores a black correction value for correcting misalignment of recording positions of the black nozzle array in the main scanning direction on the forward pass and the backward pass of the main scan which is determined according to correction information that represents a favorable correction state selected based on a black positional misalignment test pattern, the black positional misalignment test pattern being printed on a printing medium with a representative black nozzle sub-array, the representative black nozzle sub-any being included in the black nozzle array and being within a predetermined range around a center of the black nozzle array, and the positional misalignment correction unit corrects misalignment of recording positions of the color nozzle array and the black nozzle array In the main scanning direction occurring in bidirectional printing using a mean value of the color correction value the black correction value.

6. A printing apparatus in accordance with claim 5, wherein the positional misalignment correction unit:

corrects the misalignment of recording positions of the color nozzle array and the black nozzle array using the mean value of the color correction value and the black correction value in a print mode in which the color nozzle array Is used, and corrects misalignment of recording positions of the black nozzle array using the black correction value in a print mode in which the color nozzle may is not used.

7. A printing apparatus that carries out bidirectional, reciprocating main scan and prints on a a print head having a color nozzle array which is arranged in a sub-scanning direction and comprises a plurality of nozzle sub-arrays each of which ejects ink droplets in one color to record dots on the printing medium;

a memory that stores a color correction value for correcting misalignment of recording positions of the color nozzle array in a main scanning direction on a forward pass and a backward ness of the main scan; and a positional misalignment correction unit that corrects using the color correction value the misalignment of recording positions of the color nozzle array in the main scanning direction occurring in bidirectional printing, wherein the plurality of nozzle sub-arrays include a representative color nozzle sub-array which is within a predetermined range around a center of the color nozzle array, and the color correction value is determined according to correction information that represents a favorable correction state selected based on a color positional misalignment test pattern, the color positional misalignment test pattern being printed on a printing medium with the representative color nozzle sub-array, wherein the print head further comprises a black nozzle array, the memory further stores a black correction value for correcting misalignment of recording positions of the black nozzle array in the main scanning direction on the forward pass and the backward pass of the main scan which is determined according to correction information that represents a favorable correction state selected based on a black positional misalignment test pattern, the black positional misalignment test pattern being printed on a printing medium with a representative black nozzle sub-array, the representative black nozzle sub-way being included in the black nozzle array and being within a predetermined rage around a center of the black nozzle array, and the positional misalignment correction unit:

corrects the misalignment of recording positions of the color nozzle may in the main scanning direction using the color correction value, and corrects misalignment of recording positions of the black nozzle may in the main scanning direction using the black correction value.

8. A method of correcting misalignment of recording positions of ink droplets in a main scanning direction on a forward pass and a backward pass of a main scan, the method comprising the steps of:

(a) preparing a printing apparatus that comprises a print heed having a color nozzle array which is arranged in a sub-scanning direction and comprises a plurality of nozzle sub-arrays each of which ejects ink droplets in one color to record dots on a printing medium, and carries out bidirectional, reciprocating main scan to complete print on the printing medium, wherein the plurality of nozzle sub-arrays include a representative color nozzle sub-array which is within a predetermined range around a center of the color nozzle array, (b) printing a color positional misalignment test pattern on a printing medium with the representative color nozzle sub-array and without another nozzle array which ejects ink droplets in one color and is beyond the predetermined range;

(c) determining a color correction value according to correction information that represents a favorable correction state selected based on the color positional misalignment test pattern; and (d) correcting with the color correction value the misalignment of recording positions of the color nozzle array in the main scanning direction occurring in bidirectional printing.

9. A method of correcting misalignment of recording positions of ink droplets in a main scanning direction on a forward pass and a backward pass of a main scan, the method comprising the step of:

(a) preparing a printing apparatus that comprises a print head having a color nozzle array which is arranged in a sub-scanning direction and comprises a plurality of nozzle sub-arrays each of which elects ink droplets in one color to record dots on a printing mediums and carries out bidirectional, reciprocating main scan to complete print on the printing medium, wherein the plurality of nozzle sub-arrays include a representative color nozzle sub-array which is within a predetermined range around a center of the color nozzle array, (b) printing a color positional misalignment test pattern on a printing medium with the representative color nozzle sub-array;

(c) determining a color correction value according to correction information that represents a favorable correction state selected based on the color positional misalignment test pattern; and (d) correcting with the color correction value the misalignment of recording positions of the color nozzle array in the main scanning direction occurring in bidirectional printing wherein the print head comprises a plurality of color nozzle rays each of which includes the representative color nozzle sub-array, wherein the step (b) includes a atop of printing a plurality of color positional misalignment test patterns with each of the representative color nozzle sub-array, the step (c) includes a step of determining a plurality of color correction values based on each of the color positional misalignment test patterns, and the step (d) includes a step of correcting the misalignment of recording positions of the plurality of color nozzle arrays in the main scanning direction occurring in bidirectional printing using a mean value of the plurality of color correction values.

10. A method of correcting misalignment of recording positions of ink droplets in a main scanning direction on a forward pass and a backward pass of a main scan, the method comprising the steps of:

(a) preparing a printing apparatus that comprises a print head having a color nozzle array which is arranged in a sub-scanning direction and comprises a plurality of nozzle sub-arrays each of which elects ink droplets in one color to record dots on a printing medium, and carries out bidirectional, reciprocating main scan to complete print on the printing medium, wherein the plurality of nozzle sub-arrays include a representative color nozzle sub-array which is within a predetermined range around a center of the color nozzle array, (b) printing a color positional misalignment test pattern on a printing medium with the representative color nozzle sub-array;

(c) determining a color correction value according to correction information that represents a favorable correction state selected based on the color positional misalignment test pattern; and (d) correcting with the color correction value the misalignment of recording positions of the color nozzle array in the main scanning direction occurring in bidirectional printing wherein the print head further comprises a black nozzle array which is ranged in the sub-scanning direction and ejects black ink droplets to record dots on the printing medium, wherein the method further includes the steps of:

(e) printing a black positional misalignment test pattern on a printing medium with a representative black nozzle sub-ray, the representative black nozzle sub-array being included in the black nozzle array and being within a predetermined range around a center of the black nozzle array; and (f) determining a black correction value according to correction information that represents a favorable correction state selected based on the black positional misalignment test pattern, and wherein the step (d) includes correcting misalignment of recording positions of the color nozzle array and the black nozzle array in the main scanning direction occurring in bidirectional printing using a mean value of the color correction value the black correction value.

11. A computer program product for correcting misalignment of recording positions of ink droplets in a main scanning direction on a forward pass and a backward pass of a main scan, the computer being connected with a printing apparatus that comprises a print head having a color nozzle array which is arranged in a sub-scanning direction and comprises a plurality of nozzle sub-arrays each of which ejects ink droplets in one color to record dots on a printing medium, and carries out bidirectional, reciprocating main scan to complete print on the printing medium, wherein the plurality of nozzle sub-arrays include a representative color nozzle sub-array which is within a predetermined range around a center of the color nozzle array, the computer program product comprising:

a computer readable medium; and a computer program stored on the computer readable medium, the computer program comprising:

a first program for causing a computer to print a color positional misalignment test pattern on a printing medium with the representative color nozzle sub-array and without another nozzle array which ejects ink droplets in one color and is beyond the predetermined range;

a second program for causing a computer to determine a color correction value according to correction information that represents a favorable correction state selected based on the color positional misalignment test pattern; and a third program for causing a computer to correct with the color correction value the misalignment of recording positions of the color nozzle array in the main scanning direction occurring in bidirectional printing.

12. A computer program product for correcting misalignment of recording positions of ink droplets in a main scanning direction on a forward pass and a backward pass of a main scan, the computer being connected with a printing apparatus that comprises a print head having a color nozzle array which is arranged in a sub-scanning direction and comprises a plurality of nozzle sub-arrays each of which ejects ink droplets in one color to record dots on a printing medium, and carries out bidirectional, reciprocating main scan to complete print on the printing medium, wherein the plurality of nozzle sub-arrays include a representative color nozzle sub-array which is within a predetermined range around a center of the color nozzle array, the computer program product comprising:

a computer readable medium; and a computer program stored on the computer readable medium, the computer program comprising:

a first program for causing a computer to print a color positional misalignment test pattern on a printing medium with the representative color nozzle sub-array;

a second program for causing a computer to determine a color correction value according to correction information that represents a favorable correction state selected based on the color positional misalignment test pattern; and a third program for causing a computer to correct with the color correction value the occurring in bidirectional printing, wherein the print head comprises a plurality of color nozzle arrays each of which includes the representative color nozzle sub-array, and wherein the first program includes a sub-program for causing a computer to print a plurality of color positional misalignment test patterns with each of the representative color nozzle sub-arrays, the second program includes a sub-program for causing a computer to determine a plurality of color correction values based on each of the color positional misalignment test patterns, and the third program includes a sub-program for causing a computer to correct the misalignment of recording positions of the plurality of color nozzle arrays in the main scanning direction occurring in bidirectional printing using a mean value of the plurality of color correction values.

13. A computer program product for correcting misalignment or recording positions of ink droplets in a main scanning direction on a forward pass and a background pass of a main scan, the computer being connected with a printing apparatus that comprises a print head having a color nozzle array which is arranged in a sub-scanning direction and comprises a plurality of nozzle sub-arrays each of which ejects ink lets in one color to record dots on a printing medium, and carries out bidirectional, reciprocating main scan to complete print on nozzle sub-array which is within a predetermined range around a color nozzle array, the computer program product comprising:

a computer readable medium; and a computer program stored on the computer readable medium, the computer program comprising:

a first program for causing a computer to print a color positional misalignment test pattern on a printing medium with the representative color nozzle sub-array;

a second program for causing a computer to determine a color correction value according to correction information that represents a favorable correction state selected based on the color positional misalignment test pattern; and a third program for causing a computer to correct with the color correction value the misalignment of recording positions of the color nozzle array in the main scanning direction occurring in bidirectional printing, wherein the print head further comprises a black nozzle array witch is arranged in the sub-scanning direction and ejects black ink droplets to record dots on the printing medium, wherein the computer program stored on the computer readable medium further includes;

a fourth program for causing a computer to print a blank positional misalignment test pattern on a printing medium with a representative black nozzle sub-array, the representative black nozzle sub-may being included in the black nozzle array and being within a predetermined range around a center of the black nozzle array; and a fifth program for causing a computer to determine a black correction value according to correction information that represents a favorable correction state selected based on the black positional misalignment test pattern, and wherein the third program includes a sub-program for causing a computer to correct the misalignment of recording positions of the color nozzle array and the black nozzle array in the main scanning direction occurring in bidirectional printing using a mean value of the color correction value the black correction value.

* * * * *